United States Patent [19]

Luria

[11] 4,301,636

[45] Nov. 24, 1981

[54] RIGID SHELF CONNECTOR

[76] Inventor: Steven R. Luria, 1008 Willard Dr., Blacksburg, Va. 24060

[21] Appl. No.: 132,653

[22] Filed: Mar. 21, 1980

[51] Int. Cl.[3] ..... E04C 1/10; E04C 1/30

[52] U.S. Cl. ..... 52/584; 312/111; 312/140; 403/405

[58] Field of Search ..... 403/405, 403, 231, 205, 403/217; 52/582, 584; 312/140, 111, 257 SK, 257 A; 297/111; 108/111

[56] References Cited

U.S. PATENT DOCUMENTS

| | | | |
|---|---|---|---|
| 3,670,899 | 6/1972 | Kronenberg et al. | 403/231 X |
| 3,685,465 | 8/1972 | Haumer | 312/111 X |
| 4,189,884 | 2/1980 | Pecoraro | 52/584 X |

FOREIGN PATENT DOCUMENTS

| | | | |
|---|---|---|---|
| 2128222 | 1/1973 | Fed. Rep. of Germany | 403/405 |
| 2515118 | 10/1976 | Fed. Rep. of Germany | 403/405 |

*Primary Examiner*—Wayne L. Shedd
*Attorney, Agent, or Firm*—Fleit & Jacobson

[57] ABSTRACT

Disclosed is a connector for releasably joining a plurality of substantially planar elements, such as shelves and uprights, together in a predetermined angular relationship by gripping adjacent edge portions of the respective elements. The connector comprises a central core member and a series of gripping members which screw into the core member and grip the planar elements therebetween.

10 Claims, 6 Drawing Figures

RIGID SHELF CONNECTOR

BACKGROUND OF THE INVENTION

This invention relates to a connector means for releasably attaching together a plurality of substantially planar elements in a predetermined angular relationship, by gripping edge portions of the respective elements. For example, the connector means of the invention is particularly suitable for use in knock-down type shelving systems and the like, for forming joints between shelves or other planar horizontal members and uprights, or for forming joints between adjacent shelves or adjacent uprights. Numerous other applications can be found however for the inventive connector means, for example in joining planar base elements for furniture, to form cruciform-like stands or for forming joints between table tops and legs and the like.

It is an object of the invention to provide a reusable connector means for releasably attaching together a plurality of substantially planar elements in a predetermined angular relationship, by gripping edge portions of the respective elements.

A further object of the invention is to provide a connector means of the type defined in the preceding paragraph which can be reasonable economically manufactured from readily available materials and which is robust and durable in use. Another object of the invention is to provide a connector means as defined in the two preceding paragraphs, which is simple to use and does not require any special tools or particular skills for its application or removal.

Yet another object of the invention is to provide a connector means as defined in the three preceding paragraphs which has a pleasing appearance.

Still a further object of the invention is to provide a connector means as defined in the four preceding paragraphs, particularly suited for joining planar elements in cruciform fashion, for use for example in knock-down shelving and like knock-down systems.

Yet another object of the invention is to provide a connector means for releasably attaching planar elements together in a predetermined angular relationship, by gripping edge portions of the respective elements between adjustable gripping members.

SUMMARY OF THE INVENTION

The invention is based on a connector means of the type in which adjacent edges of planar elements, such as shelves or the like, to be joined, are releasably clamped or gripped between adjacent wedge-like gripping members which screw into a central core member.

For use in a knock-down shelving system, for example, or in like applications, where the planar elements are to be joined in mutually orthogonal planes, the core member preferably has a rectangular profile with flattened corners and the gripping members screw into the corners of the core member. Adjacent gripping members have mutually parallel opposing surfaces, which together with the outer flat surfaces of the core member define channel-like openings in which the edges of the respective planar elements are received. The width of each channel-like opening when the wedge members are screwed fully home onto the core member, is designed to be slightly less than the nominal thickness of the planar elements to be joined, so that the screw adjustability of the gripping members with respect to the core member allows the planar elements to be tightly gripped therebetween. With this cruciform type connector it is strictly only necessary for alternate ones of the gripping members to be adjustably screw connected to the core member and the other two gripping members could be permanently fixed to, or integrally formed with the core member.

Optional features of the invention include the formation of a through-bore in the core member, for receipt of a support rod or the like, for use for example in suspending a shelf system from a wall, and the provision of a wall bracket incorporating a form of support rod and having a recess into which the connector means fits.

Connectors in accordance with the invention may be made in metal, hard plastics or other suitable robust and durable materials, by conventional moulding, casting or machining techniques, and provide a simple and convenient reusable means whereby adjacent planar elements can be releasable joined together in a predetermined angular relationship, with the use of a single hand-tool such as a screw driver, Allen key or the like.

The invention will now be described by way of example with reference to the accompanying drawings.

DESCRIPTION OF PREFERRED EMBODIMENT

Figure 4:
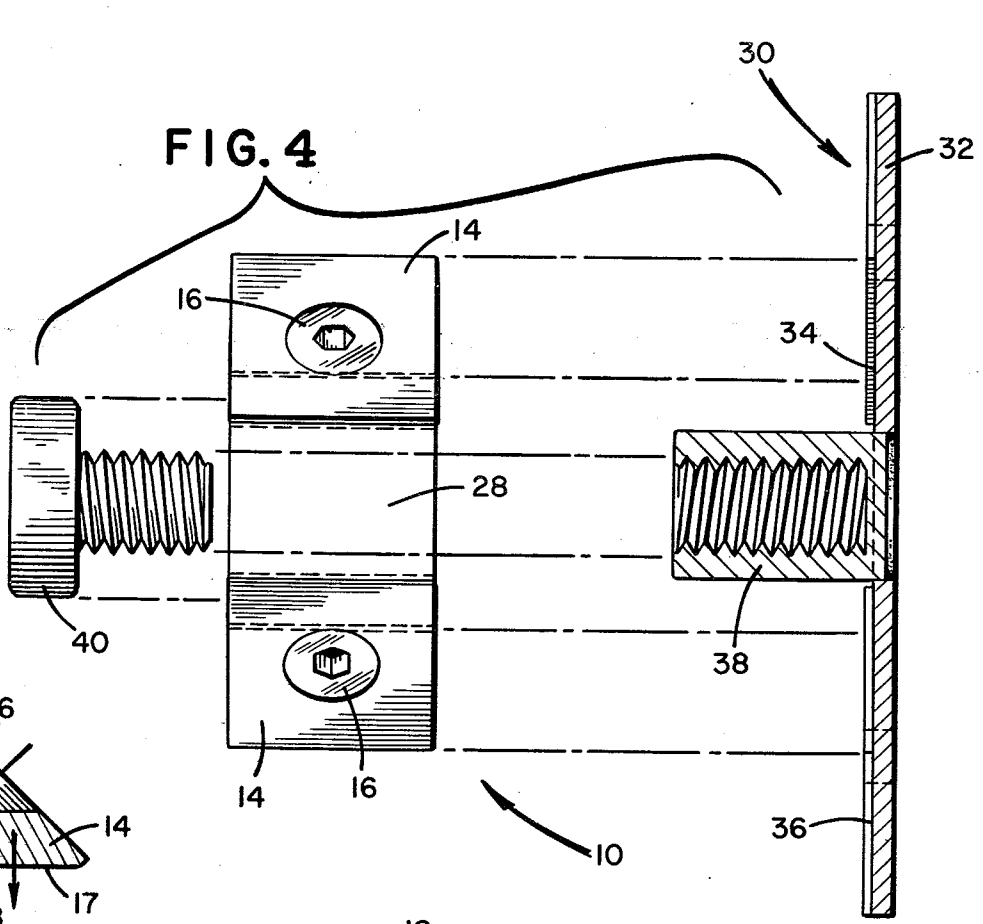
FIG. 4 is a sectional view of the connector means and bracket.
Figure 2:
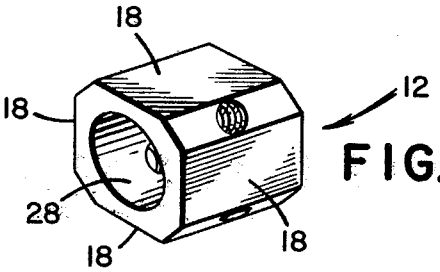
FIG. 2 is a perspective view of a core member of the connector means shown in FIG. 1.
Figure 3:
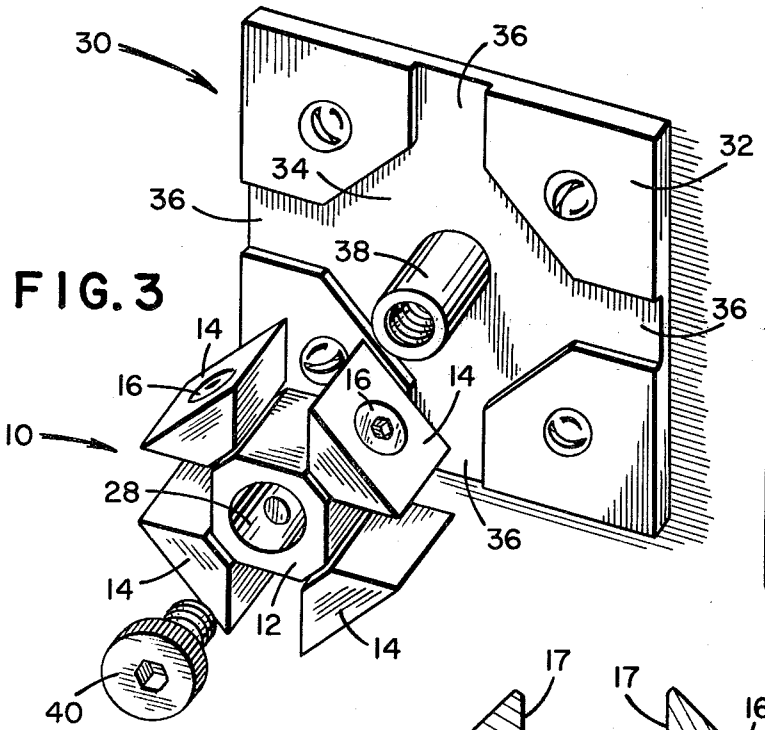
FIG. 3 is an exploded perspective view of the connector means in association with a wall mounting bracket.
Figure 1:
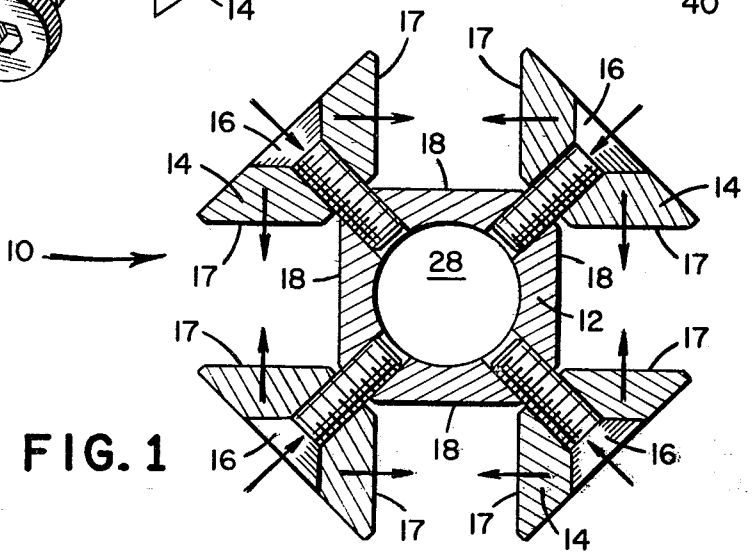
FIG. 1 is a sectional view of a connector means suitable for forming a joint between adjacent shelves and uprights of a knock-down shelving system.

As best illustrated in FIGS. 1 to 3, the basic connector means 10 of the instant invention comprises a central core member 12, a series of four wedge-like gripping members 14 and Allen-type screws 16, by which the respective gripping members can be adjustably screwed into the core member. Core member 12 and gripping members 14 can be made of any suitable durable material such as metal or hard plastics.

Core member 12 is generally rectangular in cross section, with flattened corners, and the gripping members are generally triangular in cross section, with flattened apeces complimentary to the flattened corners of the core member. Further, the gripping members are configured so that adjacent ones of these present parallel opposed edges 17 which, in conjunction with the flat outer surfaces 18 of the core member, provide channel-like openings for receipt of the edge portions of adjacent planar elements to be joined together.

Figure 6:
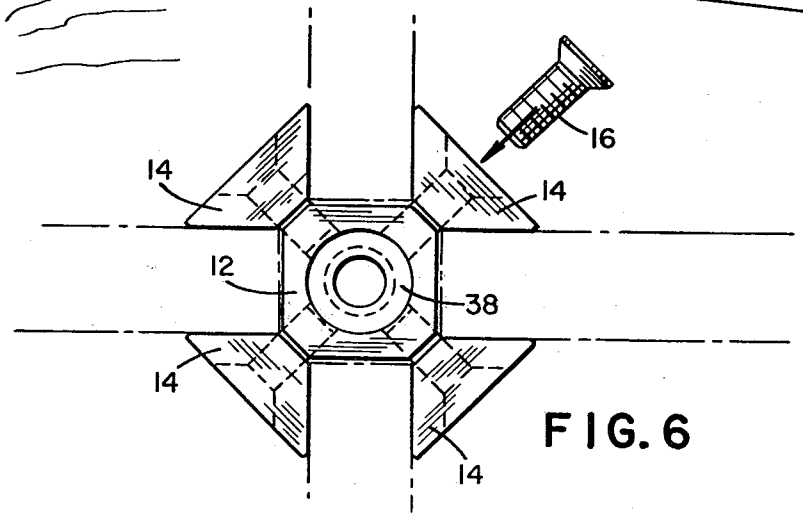
FIG. 6 is a sectional view illustrating the manner in which adjacent shelves and uprights are joined using the connector means.

It will be seen that the gripping members screw radially into and out of the core member, with respect to the central axis of the core member, so that as indicated by the horizontal and vertical arrows in FIG. 1, as the gripping members are screwed progressively further into core member, the distance between adjacent gripping members is reduced. Thus, the gripping members can be tightened down onto the opposite surfaces of the edge portions of adjacent planar elements to be joined, to tightly grip the planar elements and form a sturdy joint as illustrated in FIG. 6. The planar elements are thus releasably joined together in a relative angular relationship which is established by the configuration of the connector means 10.

Figure 5:
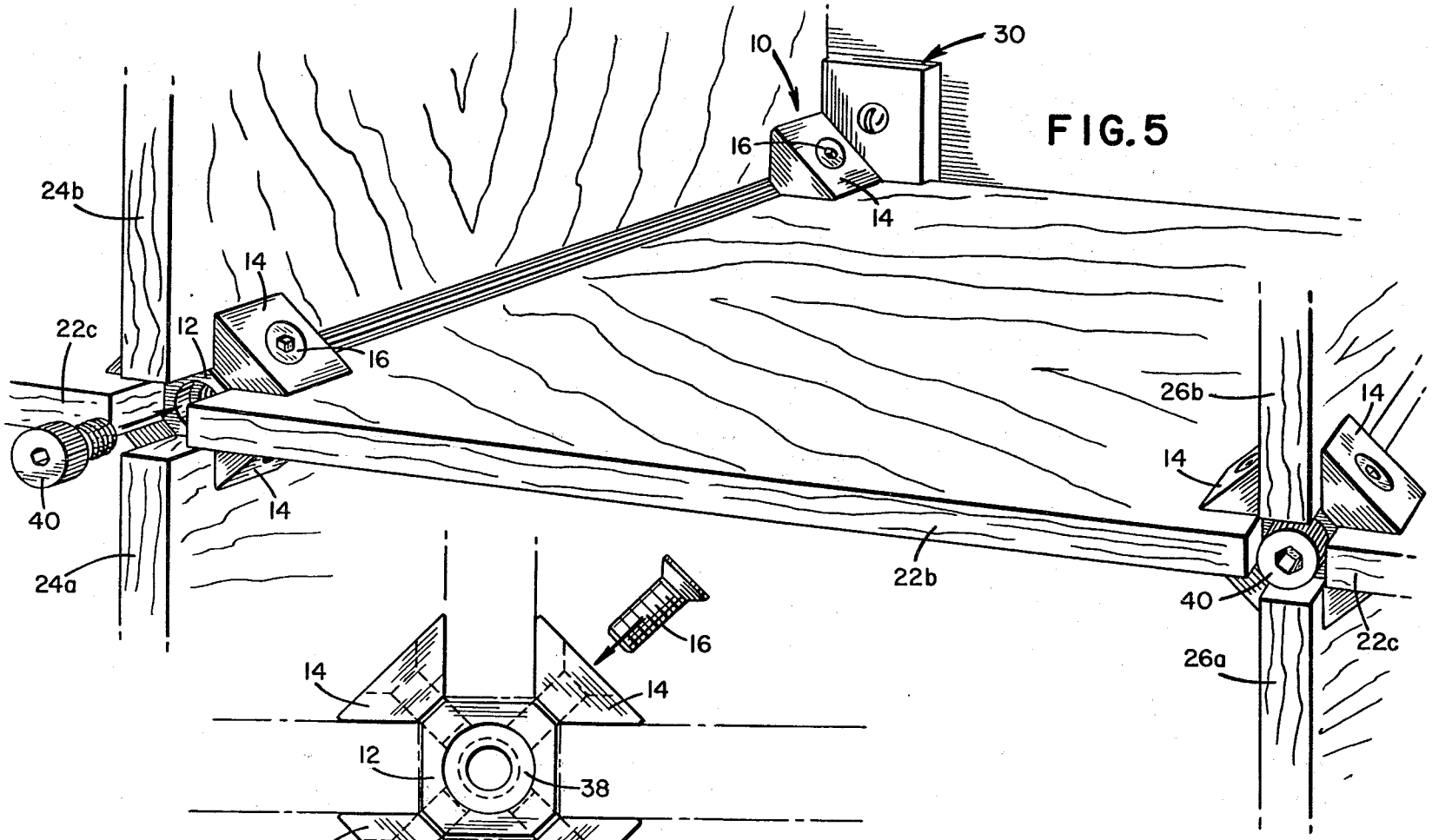
FIG. 5 is a perspective view of part of a knock-down shelving system using the connector means and bracket shown in the preceding figures.

In the illustrated example, the connector means is designed to interconnect four planar elements in mutually orthogonal planes, and its application to a knock-down shelving system is illustrated in FIG. 5 where, as shown, separate connectors 10 are used front and back to form the joints between adjacent shelves 22*a*, 22*b* and 22*c*, and uprights 24*a*, 24*b* and 26*a*, 26*b*.

Further, while the illustrated connector means comprises a substantially rectangular core member 12 and four gripping members 14, for connecting four planar elements in mutually orthogonal planes, it will be understood that the invention can also be used to connect planar members in other configurations. For example, the connector means may be used to connect three planar elements at 120° mutual angular displacements, by using only three suitably configured gripping members and a hexagonally profiled core member. This form of connector means may be used for example in connecting adjacent planar members in the formation of bases for tables and the like.

Further, while in the illustrated arrangement, all of the gripping members screw into the core member, a similar result can be achieved if only alternate ones of the gripping members are screw-adjustably mounted and the other gripping members are fixed in relation to the core member.

It will be further noted that core member 12 includes an axial through-bore 28. In a knock-down shelving system of the type shown in FIG. 5 for example, the through bores 28 of the respective connectors can be used to suspend the shelving system on horizontal rods or the like extending from suitably attached wall mounts.

A refinement of the invention, for particular use in knock-down shelving systems, comprises a wall bracket 30 into which the rear connectors 10 of the shelving system shown in FIG. 5 fit. The bracket comprises a plate 32 having a central recess 34 on its front face, which conforms in outline to the outline of connector means 10, with a degree of peripheral clearance. Recess 34 has channel-like extensions 36 aligning with the openings between the gripping members and forming locating grooves for the respective shelves and uprights. The bracket further includes a projecting, centrally located, internally threaded post 38 of a height substantially conforming to the thickness of connector means 10, and a cooperating Allen screw 40.

In use, bracket 30 is screwed or otherwise attached to a wall, and connector 10 is attached by means of screw 40 with the gripping members 14 being in a loosened condition. The shelves and uprights are positioned in the openings between adjacent gripping members and located in the recess extensions 36. Gripping members 14 are then screwed tight against the shelves and uprights to grip these firmly therebetween. The connector 10 for the front of the shelves then can be slid into place and tightened by screwing down of its gripping members. Alternatively, as shown in FIG. 5, the bracket post 38 can be longer and extend substantially the full width of the shelves. In this case, the shelving will be preassembled, by means of the connectors 10 and then mounted in an assembled state on the elongated posts 38. Allen keys 40 are then inserted into the posts 38 at the front of the assembly to hold this in place.

It will be seen from the foregoing description that the invention provides a connector means for releasably attaching together a plurality of substantially planar elements in a predetermined angular relationship, by gripping edge portions of the respective elements, which connector means is relatively simple to operate by means of a single readily available hand tool such as an Allen key, and which connector means can be readily demounted and reused. Further, the connector means can be readily produced by conventional casting, moulding or machining techniques and can be manufactured in readily available materials.

While only a single preferred embodiment of the invention has been described in detail, it will be appreciated that the invention is not limited to the specific details thereof and numerous modifications can be made within the scope of the attached claims.

What is claimed is:

1. A connector means for releasably attaching together a plurality of substantially planar elements in a predetermined angular relationship, by gripping edge portions of the respective elements, said connector means comprising a core member having a central axis, at least three gripping members, and means attaching the gripping members to the exterior of the core member in peripherally spaced positions, in a manner allowing radial adjustment of at least two of said gripping members relative to said core member, adjacent pairs of gripping members each defining opposed surfaces for tightly gripping the edge portions of said substantially planar elements therebetween when said at least two of said gripping members are suitably radially adjusted with respect to said core member.

2. The connector means as defined in claim 1 including four of said gripping members and means for attaching said four gripping members to the exterior of said core member in peripherally spaced positions in a manner allowing radial adjustment of at least alternate ones of said gripping members with respect to said core member, the adjacent pairs of gripping members each defining opposed surfaces for tightly gripping the edge portions of said substantially planar elements therebetween when said at least alternate one of said gripping members are suitably radially adjusted with respect to said core member and wherein the respective opposed surfaces of said gripping members are disposed to grip said substantially planar elements in mutually orthogonal planes.

3. The connector means as defined in claim 1 or claim 2 wherein said opposed surfaces of the respective gripping members comprise flat substantially mutually parallel surfaces.

4. The connector means as defined in claim 3 wherein said core member has substantially flat outer surface portions disposed between said opposed surfaces of the respective gripping members, whereby said opposed surfaces and said outer surface portions define channel-shaped openings for receiving the respective substantially planar elements.

5. The connector means as defined in claim 2 wherein the core member is substantially rectangular in profile and said gripping members are located at the corners thereof.

6. The connector means as defined in claim 5 wherein said opposed surfaces of the respective adjacent gripping members are substantially flat and parallel to define in conjunction with flat outer surface portions of said core member channel-shaped openings for receiving the respective substantially planar elements.

7. The connector means as defined in claim 1 or claim 2 wherein said core element includes an axial through-bore.

8. The connector means as defined in claim 1 or claim 2 wherein said means for adjustably attaching said gripping members to said core member comprises screw attachment means.

9. The connector means as defined in claim 7 including a bracket means for attaching said connector means to a planar surface such as a wall, said bracket means comprising a substantially flat member, means defining a recess in the face of said flat member, said recess having a substantially centrally disposed portion substantially conforming in profile to the profile of said connector means, and further portions extending from said central portion to respective edges of said flat member, said further portions forming extensions aligning with the spaces defined between said opposing surfaces of the adjacent pairs of gripping members, and said bracket means further including a central rod-like member extending outwardly from said recess for receipt in said through-bore of said connector means.

10. The connector means as defined in claim 9 including an attachment means adapted for end-wise screw engagement with said rod-like member for holding said connector means on said bracket means.

* * * * *